US009169699B2

(12) United States Patent
Rytlewski

(10) Patent No.: US 9,169,699 B2
(45) Date of Patent: Oct. 27, 2015

(54) TUBING STRING WITH LATCH SYSTEM

(75) Inventor: Gary Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 440 days.

(21) Appl. No.: 13/494,669

(22) Filed: Jun. 12, 2012

(65) Prior Publication Data

US 2013/0327546 A1 Dec. 12, 2013

(51) Int. Cl.
*E21B 17/06* (2006.01)
*E21B 23/02* (2006.01)
*E21B 33/038* (2006.01)

(52) U.S. Cl.
CPC ..... *E21B 17/06* (2013.01); *E21B 23/02* (2013.01); *E21B 33/038* (2013.01)

(58) Field of Classification Search
CPC ..... E21B 17/06; E21B 23/02; E21B 33/038
USPC ..... 166/338–341, 345, 365, 377, 382; 285/4
See application file for complete search history.

(56) References Cited

U.S. PATENT DOCUMENTS

| | | | | |
|---|---|---|---|---|
| 4,688,827 | A * | 8/1987 | Bassett | 285/2 |
| 4,826,214 | A * | 5/1989 | Ratcliffe | 285/2 |
| 4,880,257 | A * | 11/1989 | Holbert, Jr. | 285/2 |
| 5,161,828 | A * | 11/1992 | Hynes et al. | 285/2 |
| 5,382,056 | A * | 1/1995 | Milberger | 285/1 |
| 6,231,265 | B1 * | 5/2001 | Rytlewski et al. | 403/322.1 |
| 6,450,541 | B1 * | 9/2002 | Bakke | 285/2 |
| 7,100,696 | B2 * | 9/2006 | Marshall | 166/377 |
| 8,210,264 | B2 * | 7/2012 | Mohr | 166/343 |
| 8,555,981 | B2 * | 10/2013 | Edwards et al. | 166/365 |
| 2003/0062169 | A1 | 4/2003 | Marshall | |
| 2008/0029274 | A1 * | 2/2008 | Rytlewski et al. | 166/375 |
| 2009/0038805 | A1 * | 2/2009 | Parks et al. | 166/341 |
| 2009/0271966 | A1 * | 11/2009 | Fotty et al. | 29/428 |

FOREIGN PATENT DOCUMENTS

| | | | |
|---|---|---|---|
| CA | 1037726 | A1 | 9/1978 |
| GB | 2193773 | A | 2/1988 |

OTHER PUBLICATIONS

Australian Examination Report for Application No. 20133205876 dated Feb. 10, 2015.
Great Britan Examination Report for Application No. GB1308752.3 dated Dec. 24, 2015.

* cited by examiner

*Primary Examiner* — Matthew Buck
(74) *Attorney, Agent, or Firm* — Patrick Traister; Brandon Clark; Jeffrey Peterson

(57) ABSTRACT

A technique facilitates a variety of well services. A tubing string is provided with a latch assembly having a lower latch assembly portion, an upper latch assembly portion, and a latch mandrel. The latch mandrel comprises a weakened region disposed in a housing of the latch assembly. Additionally, a release mechanism may be employed to facilitate release of the upper latch assembly portion from the lower latch assembly portion upon separating the latch mandrel at the weakened region.

19 Claims, 6 Drawing Sheets

TUBING STRING WITH LATCH SYSTEM

BACKGROUND

Hydrocarbon fluids such as oil and natural gas are obtained from a subterranean geologic formation, referred to as reservoir, by drilling a well that penetrates the hydrocarbon-bearing formation. In a variety of subsea applications, a landing string is conveyed down to a subsea well head to facilitate a variety of subsea operations, such as subsea completion operations, flow testing operations, intervention operations, and other subsea well operations. In some applications, the landing string comprises a weak link which enables severing of the landing string upon the occurrence of certain events. During preparation and deployment of the landing string, the weak link potentially can incur detrimental bending loads. Additionally, severance at the weak link and removal of the upper portion of the landing string can create torn control line hoses, damaged components, and debris which can cause delays due to cleanup prior to running a subsequent landing string.

SUMMARY

In general, the present disclosure provides a system and method for facilitating well services. A tubing string is provided with a latch assembly having a lower latch assembly portion, an upper latch assembly portion, and a latch mandrel. The latch mandrel comprises a weakened region disposed in a housing of the latch assembly. Additionally, a release mechanism may be employed to facilitate release of the upper latch assembly portion from the lower latch assembly portion upon separating the latch mandrel at the weakened region.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
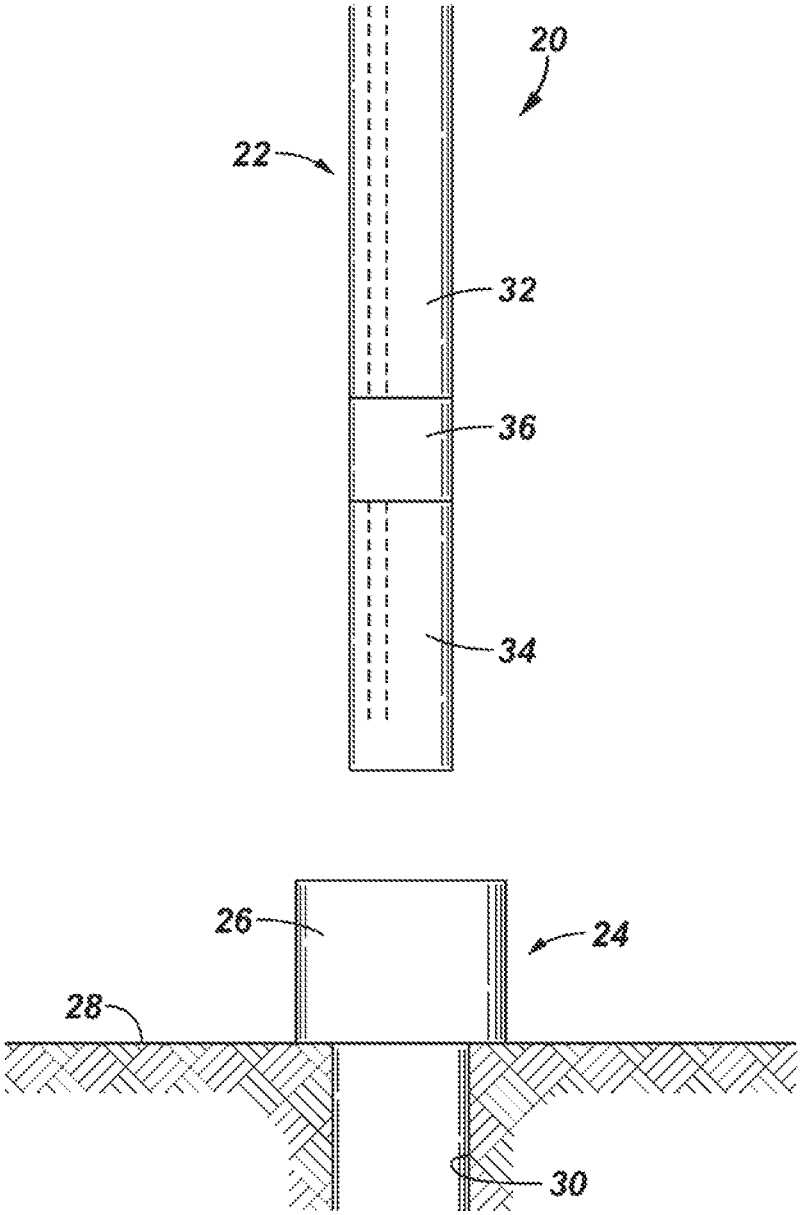
FIG. 1 is an illustration of an example of a well system comprising a tubing string, e.g. a landing string, and a latch assembly according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to facilitating a variety of well services. The technique utilizes a tubing string with a latch assembly having lower and upper latch assembly portions which may be separated to enable removal of the upper section of the tubing string. The design of the latch assembly enables easy re-engagement of an upper latch assembly portion with the lower latch assembly portion remaining downhole.

In a specific example, the system comprises a landing string with a latch assembly. The landing string may be a subsea landing string for use in offshore well applications. In this latter example, the subsea landing string system enables completion testing, flow testing, intervention, and/or other subsea well operations to be performed from a floating vessel. The landing string may comprise a variety of components, including mechanical barriers and the latch assembly, to enable selective disconnection of the subsea landing string and subsequent re-engagement.

According to an example, the latch assembly is coupled into the landing string at a desired position and comprises a lower latch assembly portion and an upper latch assembly portion. The upper latch assembly portion is selectively engageable with the lower latch assembly portion. The latch assembly also comprises a latch mandrel which is received in the upper latch assembly and has a weakened region located within a housing of the upper latch assembly. This weakened section in the latch mandrel provides a known tensile strength at a specific location in case of, for example, an emergency related to the rig heave motion compensator locking up when the tubing hanger is locked into the subsea wellhead at the seafloor. If the heave compensator does lock (a known occurrence) when the tubing hanger is locked, rig heave due to waves can quickly place extreme tensile loads on the landing string. The weakening of the latch mandrel is design to relieve the extreme tensile loading before wellhead failure or other more serious failures occur. Some latch mandrels are therefore designed to fail in tension at a known load and position such that the shear and blind rams in the blowout preventer (BOP) can quickly be closed to control the well. Placement of the weakened region in the housing protects the latch mandrel against bending loads while still creating a breakpoint enabling selective breaking/disconnection upon application of a predetermined tensile load on the latch mandrel. In some applications, the latch assembly also comprises a release mechanism which releases the upper latch assembly portion from the lower latch assembly portion when the landing string is pulled or lifted to separate the latch mandrel sections at the weakened region. The release mechanism also may be designed to retain and remove the separated sections of the latch mandrel with the upper latch assembly portion. Depending on the design of the landing string, a variety of control lines, e.g. hydraulic and electrical control lines, may be coupled to the latch assembly via corresponding wet connects which allow disengagement and re-engagement of the control lines during corresponding disengagement and re-engagement of the upper and lower latch assembly portions.

In the example illustrated in FIG. 1, a well system 20 is illustrated as comprising a tubing string 22, e.g. a landing string, used in a well 24. For example, the landing string 22 may be received by a subsea wellhead 26 in a subsea application in which the subsea wellhead 26 is located along a seafloor 28 above a wellbore(s) 30. Depending on the application, the landing string 22 may comprise a variety of components including an upper landing string 32 and a lower landing string 34 coupled by a latch assembly 36. The landing string 22 also may comprise a variety of other components, e.g. valves, sliding sleeves, sensors, and other devices depending on the specific application. The components may be selected and designed to enable, for example, completion testing; flow testing, intervention, and/or other subsea well service operations to be performed from a floating vessel. A plurality of control lines 84, e.g. hydraulic and/or electrical control lines, may be routed through the latch assembly 36 to enable flow of control signals and/or data signals with respect to landing string components and/or other well system components.

Figure 2:
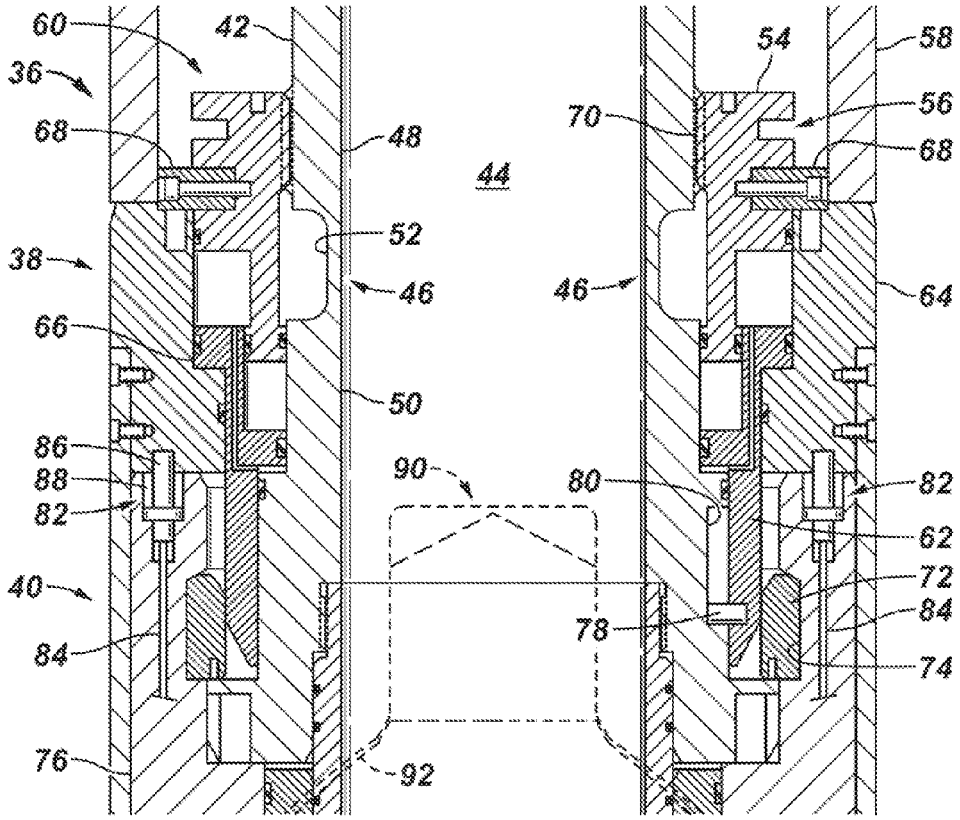
FIG. 2 is a cross-sectional view of an example of the latch assembly illustrated in FIG. 1, according to an embodiment of the disclosure.

Referring generally to FIG. 2, an example of latch assembly 36 is illustrated. In this example, latch assembly 36 comprises an upper latch assembly portion 38, a lower latch assembly portion 40, and a latch mandrel 42. The upper latch assembly portion 38 is releasably engaged with the lower latch assembly portion 40, and the latch mandrel 42 is received in upper latch assembly portion 38. A flow passage 44 extends in a longitudinal direction generally through a center of the latch mandrel 42 and the overall latch assembly 36 to provide a flow path for well fluids or other fluids during operation of the tubing/landing string 22. The latch mandrel 42 also comprises a weakened region 46 which allows separation, e.g. breakage, of the latch mandrel 42 into an upper latch mandrel section 48 and a lower latch mandrel section 50. By way of example, the weakened region 46 may be formed by a recess 52, such as a notch in the latch mandrel 42 or a circumferential groove around the latch mandrel 42. Tensile loading of the upper landing string 32, and thus of the latch mandrel 42, may be used to cause breakage and separation of the latch mandrel at weakened region 46.

In the illustrated embodiment, however, the latch mandrel 42 and weakened region 46 are protected against bending loads by a surrounding housing 54 of upper latch assembly portion 38. The surrounding housing 54 effectively provides a thicker support section able to prevent certain bending loads from breaking latch mandrel 42 at weakened region 46. The housing 54 may be constructed in a variety of forms and configurations. As illustrated, for example, the housing may comprise a retrieval tool latch 56 to which a retrieval tool may be connected downhole to facilitate removal of the upper latch assembly portion 38 in certain situations. Such a retrieval tool may be guided into engagement with the retrieval tool latch 56 by a guide member 58.

In the example illustrated, the latch assembly 36 further comprises a release mechanism 60 which may be mounted on or constructed as part of upper latch assembly portion 38. The release mechanism 60 is designed to enable controlled release (and subsequent re-engagement) of upper latch assembly portion 38 with respect to lower latch assembly portion 40. In the illustrated embodiment, release mechanism 60 also is designed to retain the lower latch mandrel section 50 with the upper latch assembly portion 38 when the upper latch assembly portion 38 is withdrawn.

By way of example, release mechanism 60 comprises a piston 62 connected to a body member 64 by an expanded piston region 66. The body member 64, in turn, is coupled with housing 54 via a fastening mechanism 68, such as a threaded fastener. The housing 54 may be connected with latch mandrel 42 by a fastener 70, e.g. a threaded engagement region, located along the upper latch mandrel section 48 of latch mandrel 42.

In this example, the piston 62 is employed to retain a lock or retention ring 72 of upper latch assembly portion 38 in engagement with a corresponding engagement feature 74, e.g. annular recess, formed in a lower housing 76 of lower latch assembly portion 40. The lock ring 72 holds upper latch assembly portion 38 in engagement with lower latch assembly portion 40 as long as piston 62 holds the lock ring 72 in engagement with the engagement feature 74. If piston 62 is pulled clear of lock ring 72, the lock ring 72 is designed to move out of engagement with the engagement feature 74. For example, the lock ring 72 may be in the form of a spring member which springs radially inwardly and out of engagement with engagement feature 74 once piston 62 is moved away from its lock ring blocking position. In the embodiment illustrated, a pin 78 extends from piston 62 into a corresponding slot 80 of the lower latch mandrel section 50 of latch mandrel 42 to ensure removal of the lower latch mandrel section 50 when the upper landing string 32 and the upper latch assembly portion 38 are separated and removed from lower landing string 34 and lower latch assembly portion 40.

As further illustrated in FIG. 2, the latch assembly 36 also may comprise at least one wet connect 82, e.g. a wet mate connector, designed to facilitate engagement and disengagement of control lines 84. By way of example, control lines 84 may comprise hydraulic control lines, electrical control lines, or other types of control lines. In the specific example illustrated, the latch assembly 36 comprises a plurality of wet connects 82 used to couple both hydraulic lines 82 and electrical lines 82. Each wet connect 82 may comprise a male portion 86 and a female portion 88 to facilitate engagement and disengagement of the corresponding control line 84 during engagement and disengagement, respectively, of upper latch assembly portion 38 with respect to lower latch assembly portion 40.

In some applications, the latch assembly 36 also may comprise an alignment system 90 designed to automatically align the upper latch assembly portion 38 with the lower latch assembly portion 40 during an engagement operation. The alignment system 90 may be designed to rotate the upper latch assembly portion 38 to properly align male portions 86 and female portions 88 of wet connects 82 during engagement of the latch assembly. In some applications, the alignment system 90 may comprise a helix 92, but the alignment system 90 also may comprise additional or other components, such as alignment slots, alignment pins, or other alignment features. In certain applications, the alignment system 90 may comprise a series of alignment systems which sequentially provide greater precision of alignment. For example, helix 92 may be used to provide general alignment, while an alignment slot increases the precision of the alignment, and alignment pins provide the final precise alignment of wet connects 82. However, a variety of features and combinations of features may be used in the alignment system 90 depending on the design of the overall latch assembly 36 and on the parameters of a given application.

Figure 3:
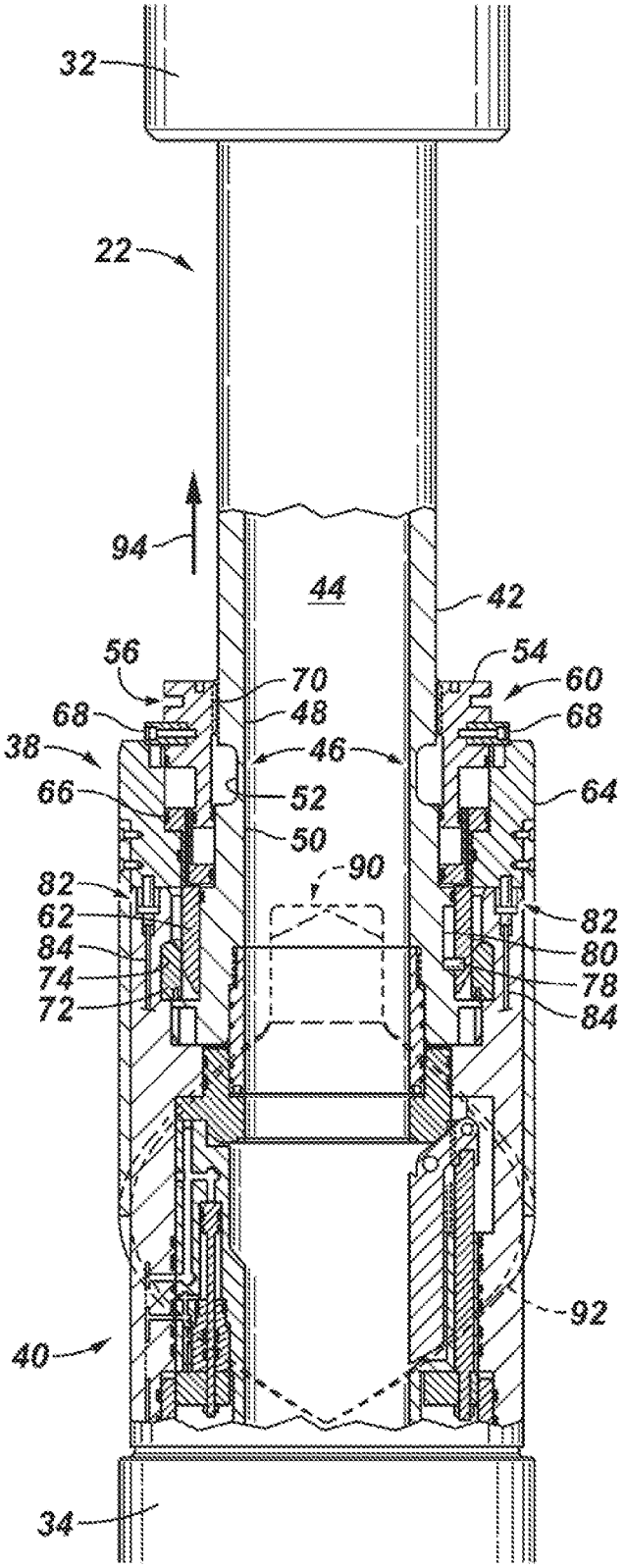
FIG. 3 is a cross-sectional view of an example of the latch assembly employed in a landing string, according to an embodiment of the disclosure.
Figure 4:
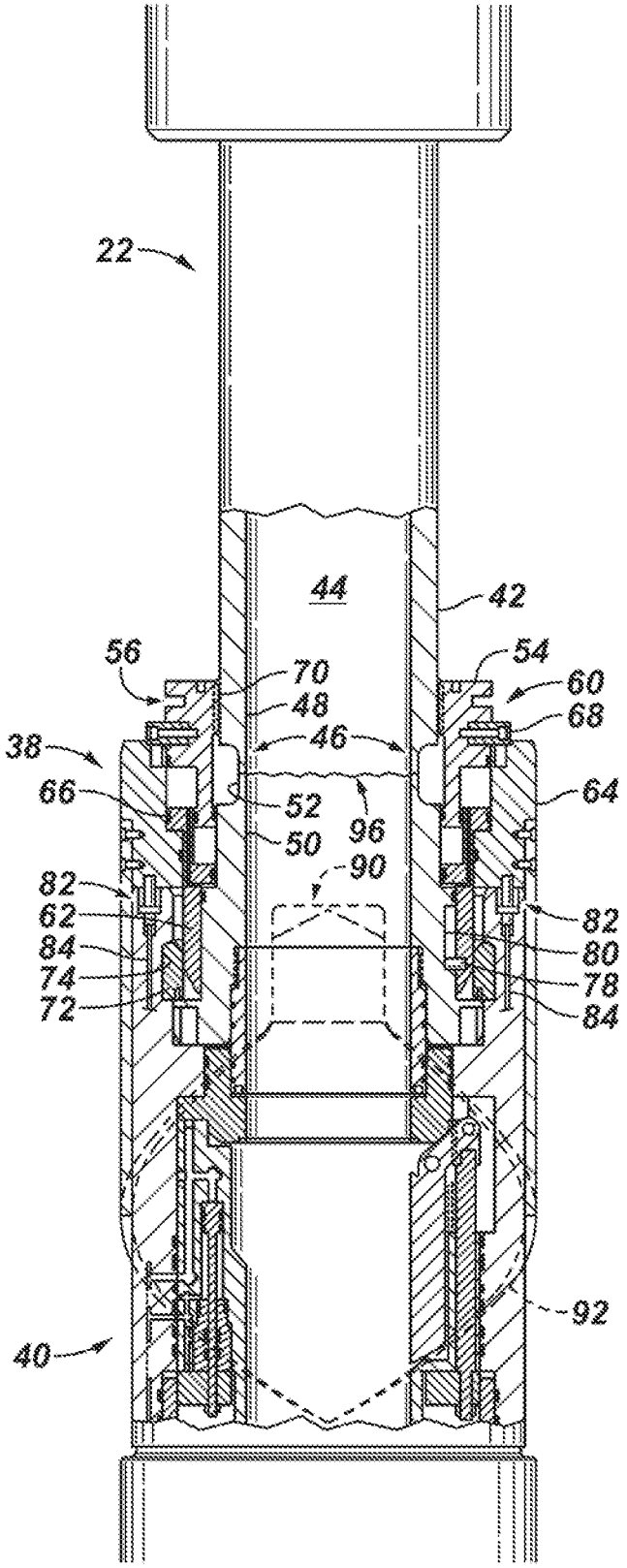
FIG. 4 is a cross-sectional view similar to that illustrated in FIG. 3 but showing the latch assembly in a different operational position, according to an embodiment of the disclosure.

Referring generally to FIGS. 3-6, an operational example employing latch assembly 36 is illustrated. In this example, the upper latch assembly portion 38 is connected to the upper landing string 32 of a subsea landing string 22, and the lower latch assembly portion 40 is connected to the lower landing string 34 of the subsea landing string 22, as illustrated in FIG. 3. The upper latch assembly portion 38 may be connected to the upper landing string 32 via latch mandrel 42.

In the event separation of the latch assembly 36 is desired, a tensile load is applied to latch mandrel 42, as indicated by arrow 94. For example, a tensile load may be applied by pulling upwardly on upper landing string 32. Upon application of sufficient tensile loading, a breakpoint 96 occurs at weakened region 46 of latch mandrel 42, as illustrated in FIG.

Figure 5:
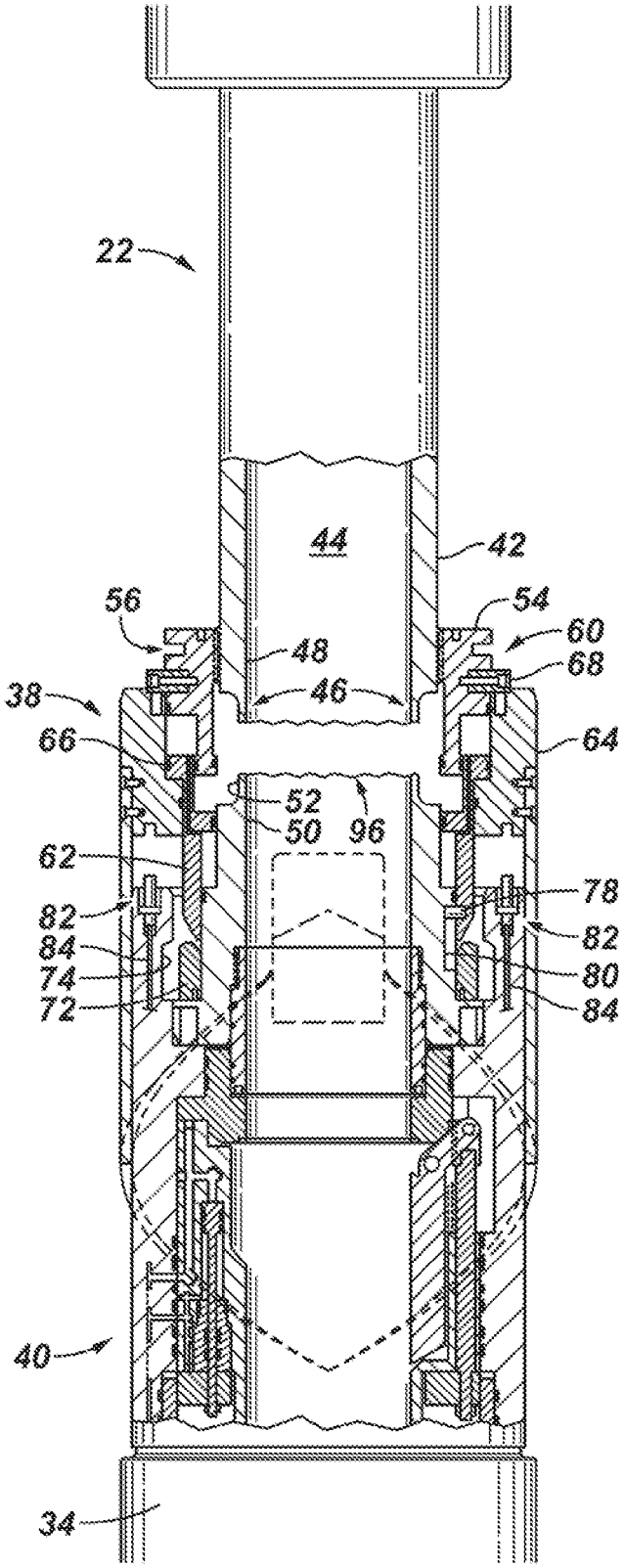
FIG. 5 is a cross-sectional view similar to that illustrated in FIG. 3 but showing the latch assembly in a different operational position, according to an embodiment of the disclosure.

4. The upper landing string 32 and upper latch assembly portion 38 may then be lifted to further separate the upper latch mandrel section 48 from the lower latch mandrel section 50, as best illustrated in FIG. 5.

Pulling the upper latch mandrel section 48 upwardly causes housing 54 to move upwardly (when latch assembly 36 is oriented as illustrated) which, in turn, moves body member 64 and piston 62 in an upward direction. The upward movement of piston 62 is continued until the piston 62 clears lock ring 72, as illustrated in FIG. 5. Once the piston 62 is clear, the lock ring 72 moves radially inwardly and out of engagement with engagement feature 74 to enable separation of the upper latch assembly portion 38 from the lower latch assembly portion 40. Simultaneously, pin 78 is moved upwardly by piston 62 along slot 80 of the lower latch mandrel section 50 until reaching the top of the slot.

Figure 6:
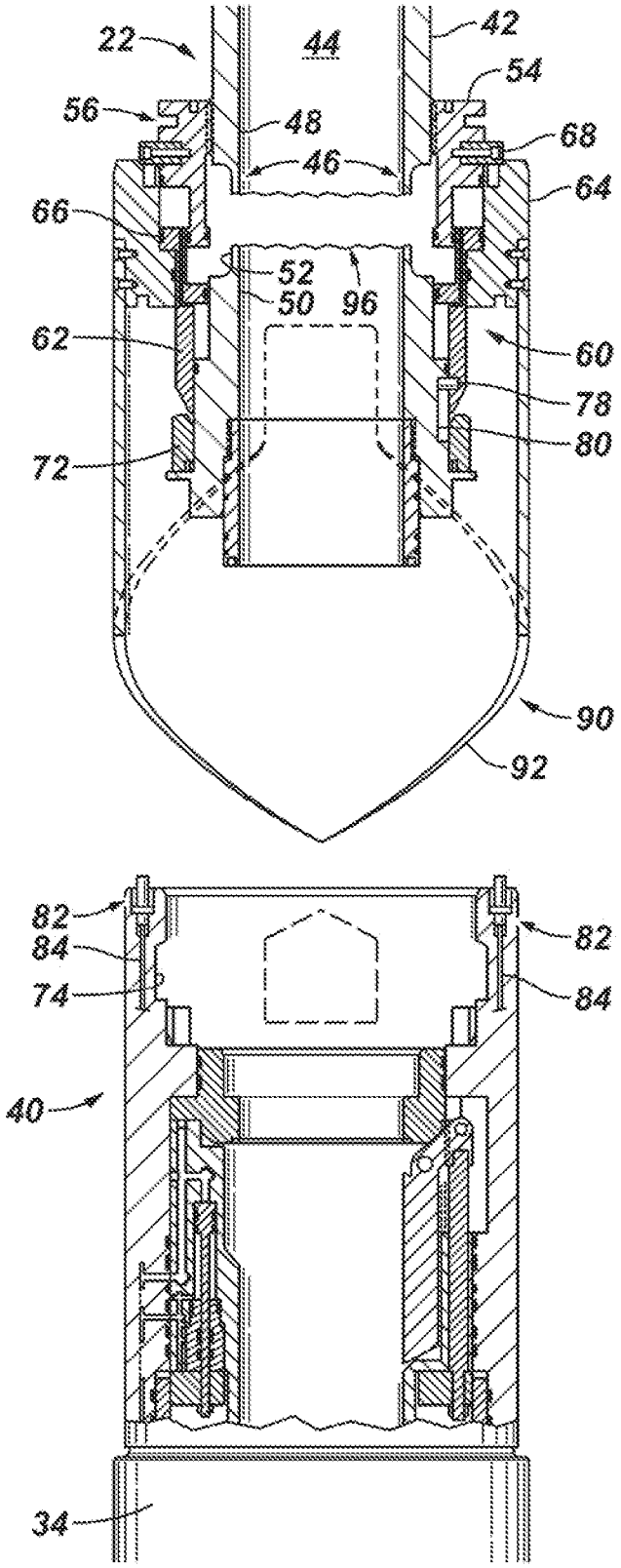
FIG. 6 is a cross-sectional view similar to that illustrated in FIG. 3 but showing the latch assembly in a different operational position, according to an embodiment of the disclosure.

Continued upward movement of upper latch assembly portion 38 causes pin 70 to lift the lower latch mandrel section 50 from lower latch assembly portion 40, as best illustrated in FIG. 6. The wet connects 82 also allow severance of the control lines 84 without damaging the control lines. When the upper landing string 32 (or a different landing string) is again deployed for re-engagement, the latch assembly 36 facilitates a relatively simple operation of re-engagement. For example, the upper landing string 32 and the upper latch assembly portion 38 are simply re-conveyed down to the lower latch assembly portion 40 and moved into engagement. The alignment system 90 may be used to rotate upper latch assembly portion 38 for precise alignment and engagement of the control lines 84 via wet connects 82. Additionally, the piston 62 forces lock ring 72 outwardly into securing engagement with engagement feature 74. In some applications, the piston 62 and the lock ring 72 may be designed with cooperating, tapered surfaces to facilitate expansion of the lock ring 72 in the radially outward direction. Generally, the latch mandrel 42 is replaced prior to re-engagement to provide a new weakened region 46 protected against bending loads by housing 54.

The latch assembly 36 may be used with many types of tubing strings to facilitate disengagement and re-engagement of sections of the tubing string 22 while protecting the latch assembly 36 against bending loads. The latch assembly 36 may be used in both well applications and non-well applications to provide a mechanism for connecting, disconnecting, and reconnecting a variety of control lines and other components along the tubing string. As described above, the latch assembly is useful in a variety of offshore applications in which a tubing string, such as a landing string, is deployed from a floating vessel or other type of floating structure.

In subsea applications, the latch assembly protects the landing string 22 against bending forces during, for example, lifting and handling of the landing string on the floating vessel. The system and methodology leave a clean lower latch assembly portion 40 for easy reattaching of a subsequent upper latch assembly portion. The clean lower latch assembly portion 40 enables reconnection without milling broken components, without cleaning out broken control lines, and without fishing portions of the latch assembly 36.

The tubing/landing string 22 also may be employed with many types of surface facilities including drilling active works. In such applications, the landing string 22 may be used when flowing well fluid to the surface vessel to, for example, test the formation. The landing string 22 also may be employed when drilling additional wells to enable removal of initial solids to the drilling rig. During such operations, the latch assembly 36 enables rapid disconnection of the landing string without creating damage that would otherwise take substantial repair time prior to deploying a subsequent landing string.

Depending on the systems, environment, and parameters of a given application, various embodiments described herein may be used to facilitate a variety of servicing operations. Accordingly, the overall well system may comprise many types of tubing strings, components and arrangements of components. Additionally, the latch assembly 36 may comprise many types of components, materials, control line connections, alignment systems, fasteners, and other features or components to facilitate a given operation. Similarly, the latch assembly 36 may be used in cooperation with many other types of components, including valves, sliding sleeves, injection assemblies, sensors, gauges mandrels, and other components and systems.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in performing a well service, comprising:

a landing string having a latch assembly, the latch assembly comprising:

a lower latch assembly portion;

an upper latch assembly portion selectively engageable with the lower latch assembly portion; and a latch mandrel received in the upper latch assembly, the latch mandrel having a weakened region located within a housing of the upper latch assembly, the weakened region creating a breakpoint which breaks upon application of a predetermined tensile load applied by pulling up on the landing string and the latch mandrel.

2. The system as recited in claim 1, wherein the upper latch assembly portion comprises a release mechanism to selectively release the upper latch portion from the lower latch portion.

3. The system as recited in claim 2, wherein the release mechanism is actuated by lifting the latch mandrel after breaking of the latch mandrel at the weakened region.

4. The system as recited in claim 1, wherein the latch assembly comprises a plurality of wet mate connectors for coupling control lines.

5. The system as recited in claim 1, wherein the latch assembly comprises a plurality of hydraulic wet mate connectors and electrical wet mate connectors.

6. The system as recited in claim 4, further comprising an alignment system to align the plurality of wet mate connectors during engagement of the upper latch assembly portion with the lower latch assembly portion.

7. The system as recited in claim 2, wherein the release mechanism comprises a piston which cooperates with a lock ring to selectively lock and release the upper latch assembly portion and the lower latch assembly portion.

8. The system as recited in claim 2, wherein breaking the latch mandrel at the weakened region creates an upper latch mandrel section and a lower latch mandrel section, further wherein the release mechanism retains and removes the lower latch mandrel section when the upper latch mandrel section and the upper latch assembly portion are lifted away from the lower latch assembly portion.

9. The system as recited in claim 1, wherein the landing string is a subsea landing string.

10. A system, comprising:

a latch assembly for releasably coupling of a tubing string, the latch assembly comprising:

a lower latch assembly portion;

an upper latch assembly portion releasably engageable with the lower latch assembly portion;

a latch mandrel having a weakened region; and a release mechanism, wherein sufficient tension on the latch mandrel applied by pulling upward on the tubing string causes separation of the latch mandrel at the weakened region to form separate mandrel sections such that continued upward pulling of the latch mandrel releases the upper latch assembly portion from the lower latch assembly portion while retaining the separate mandrel sections with the upper latch assembly portion.

11. The system as recited in claim 10, wherein the weakened region is located within a housing of the upper latch assembly portion.

12. The system as recited in claim 10, wherein the weakened region comprises a circumferential groove formed in the latch mandrel.

13. The system as recited in claim 10, wherein the weakened region comprises a notch formed in the latch mandrel.

14. The system as recited in claim 10, wherein the lower latch assembly portion is connected to a lower section of a subsea landing string.

15. The system as recited in claim 10, wherein the latch assembly comprises a central flow passage.

16. The system as recited in claim 10, wherein the latch assembly comprises a plurality of wet connects which are engaged and disengaged when the upper latch assembly portion is engaged with or disengaged from, respectively, the lower latch assembly portion.

17. The system as recited in claim 16, wherein the plurality of wet connects comprises hydraulic wet connects and electrical wet connects.

18. A method for facilitating well services, comprising:

using a latch assembly coupled in a subsea landing string, the latch assembly comprising a lower latch assembly portion, an upper latch assembly portion, a latch mandrel having a weakened region, and a housing surrounding the weakened region; and utilizing a release mechanism to release the upper latch assembly portion from the lower latch assembly portion and to retain separated sections of the latch mandrel with the upper latch assembly portion, wherein the utilizing comprises:

parting the latch mandrel at the weakened region into an upper latch mandrel section and a lower latch mandrel section in response to pulling up on the landing string and the latch mandrel; and after parting the latch mandrel at the weakened region disengaging the release mechanism from the lower latch assembly portion in response to upward pulling on the landing string and the upper latch mandrel section.

19. The method as recited in claim 18, further comprising coupling control lines through the latch assembly via wet connects.

* * * * *